United States Patent [19]

Fischer et al.

[11] 4,147,152

[45] Apr. 3, 1979

[54] PROJECTILE PROPULSION AND CONTROL IN A GAS-POWERED GUN

[75] Inventors: Earl L. Fischer, Bentonville; Lee F. Garmon, Jr., Rogers, both of Ark.

[73] Assignee: Victor United, Inc., Chicago, Ill.

[21] Appl. No.: 803,353

[22] Filed: Jun. 3, 1977

[51] Int. Cl.[2] ..... F41B 11/06

[52] U.S. Cl. ..... 124/76; 124/41 C; 124/74; 251/107

[58] Field of Search ..... 124/40, 41 R, 41 C, 124/68, 69, 70, 74, 76; 42/10, 11; 89/161; 251/82, 83, 89, 101, 107, 354

[56] References Cited

U.S. PATENT DOCUMENTS

| | | | |
|---|---|---|---|
| 2,322,212 | 6/1943 | Allen | 124/41 UX |
| 2,980,096 | 4/1961 | Merz | 124/74 |
| 3,233,600 | 2/1966 | Spack | 124/74 |
| 3,788,298 | 1/1974 | Hale | 124/76 |

FOREIGN PATENT DOCUMENTS

| | | | |
|---|---|---|---|
| 137454 | 9/1952 | Sweden | 124/76 |
| 14447 of | 1908 | United Kingdom | 124/76 |

*Primary Examiner*—Richard T. Stouffer

*Attorney, Agent, or Firm*—Schmidt, Johnson, Hovey & Williams

[57] ABSTRACT

A projectile is propelled from the gun when a valve that controls the gas storage chamber of the gun is momentarily unseated, thereby admitting a short burst or charge of gas into the space immediately behind the projectile. The barrel that confines and controls the projectile during its movement out of the gun is itself driven rearwardly by spring action to accomplish unseating of the valve through an actuating stem at the rear of the barrel, and during such rearward movement of the barrel, the projectile is carried therewith so as to reduce the volume of the space behind the projectile in which the gas may expand before acting upon the projectile. After a predetermined amount of rearward movement, the projectile is released to thereby prevent interference with its propulsion from the gun, and return movement of the barrel forwardly after valve actuation is terminated short of its fully forward position, thereby minimizing the increase in the gas expansion space created by movement of the barrel and stem forwardly during firing. Stopping such forward movement in this way also positively precludes any opportunity for the barrel and actuating stem to oscillate in a rebounding manner between the spring that drives the barrel rearwardly and the spring controlling the valve, such activity otherwise causing a series of gas discharges after the projectile has already left the gun.

26 Claims, 18 Drawing Figures

PROJECTILE PROPULSION AND CONTROL IN A GAS-POWERED GUN

This invention relates to guns of the type that are operated by compressed gas such as, for example, $CO_2$. It will become apparent, however, that the principles of the present invention are not limited to any one specific type of gas and, indeed, may be applied to a broad spectrum of projectile propulsion mediums.

More particularly, this invention relates to ways of increasing the operating efficiency of such guns, with special attention to the manner in which the projectile-propelling charge of gas is treated once it leaves the gas storage chamber therefor.

To this end, one important object of the present invention is to move the projectile rearwardly in the gun along with the structure that unseats the valve so that the gas expansion space defined between the valve and the rear of the projectile will be decreased by such movement prior to firing, hence, reducing the amount of gas expanding energy not used for projectile propulsion.

Another important object of this invention is to remove any retentive force on the projectile after a predetermined amount of such rearward movement so that the energy of the expanding gas need not be used to overcome any projectile-holding forces and may, instead, be devoted totally to propelling the projectile from the gun.

A further important object of this invention is to minimize the increase in gas expansion space caused by return forward movement of the valve-actuating structure as it vacates the expansion chamber by terminating such forward movement at a point substantially short of the forward limit of travel for such structure. In this regard, it is an additional important object to accomplish such termination without in any way interfering with movement of the actuator rearwardly during valve unseating, or during overriding movement forwardly for cocking and loading of the gun.

Additionally, it is an important object of this invention to prevent rebounding oscillations of the actuating stem that would cause further discharges of the gas from the storage chamber subsequent to firing of the projectile, such rebound prevention being obtained through the same means that terminates excessive forward movement of the actuating structure immediately following valve actuation.

A still further important object of the invention is to obtain the foregoing objectives through structures and mechanisms that permit utilization of an axially reciprocable barrel to permit attainment of benefits derived from that type of construction, e.g., operating simplicity, reliability and manufacturing ease.

Figure 1:
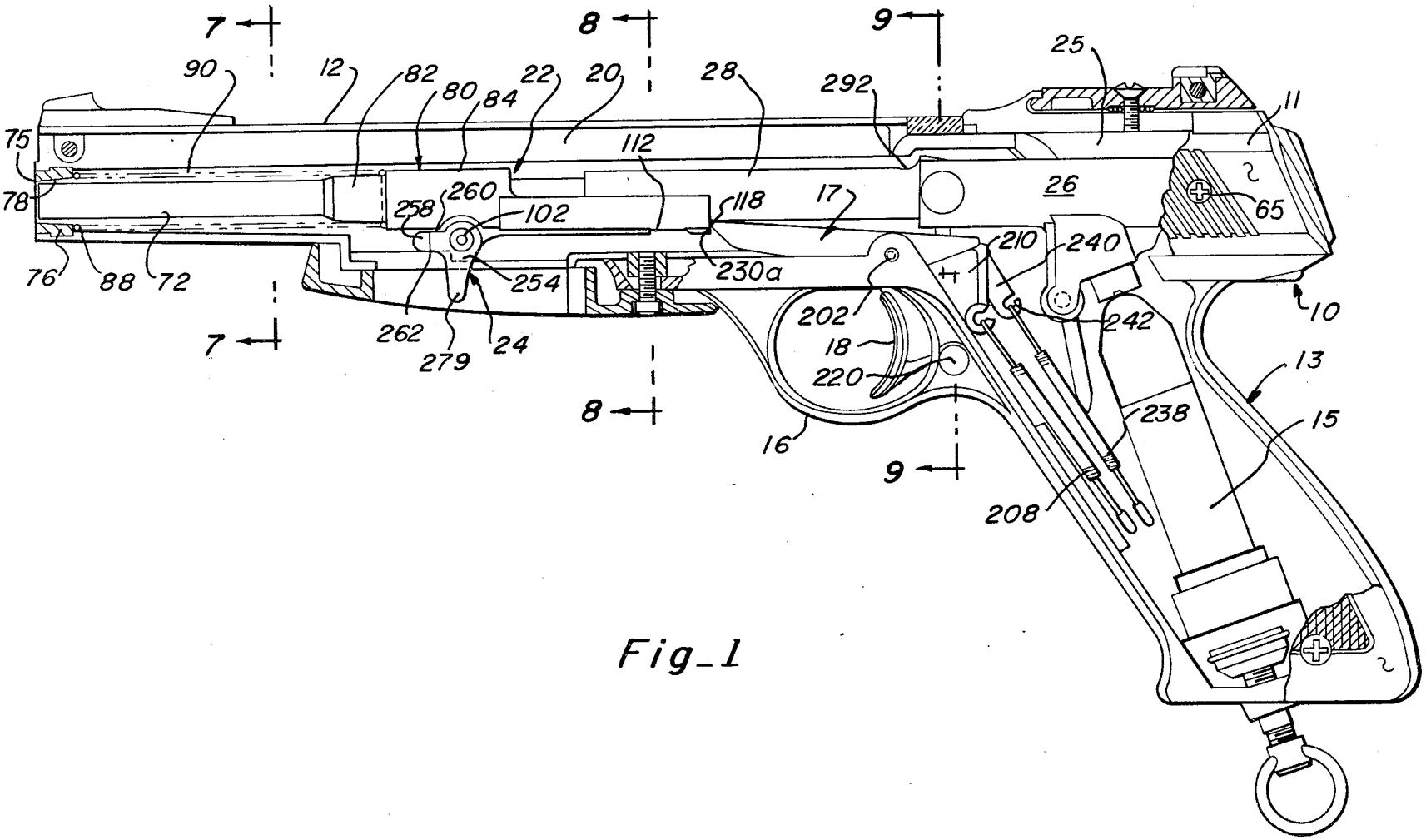
FIG. 1 is a side elevational view in partial cross section of a pistol-type gas-operated gun, with parts removed, in a cocked ready-to-fire position.

Referring now to FIGS. 1–3 and 6–9, the inventive concepts are illustratively shown in a gas-operated pistol comprising a metallic receiver assembly 10, including a pair of mating elongated side housing members 11, 12 and a handle member 13 adapted to internally mount a removable and replaceable compressed gas container (not shown) on a container seat means 15. The receiver assembly provides a trigger guard portion 16 for a sear means 17 and a trigger means 18; a barrel housing portion 20 for mounting a reciprocable barrel means assembly 22 having a valve-actuating stem means 23 at the rear thereof; a cocking and latching means member 24 pivotally mounted thereon; and a valve and valve-operating mechanism housing portion 25 for mounting a valve block assembly 26 having a support tube 28 fixedly secured therein. As illustrated, the foregoing components associated with propulsion of the projectile and control of the gas used in such propulsion all lie along a common longitudinal axis for "in-line" operation.

Figure 2:
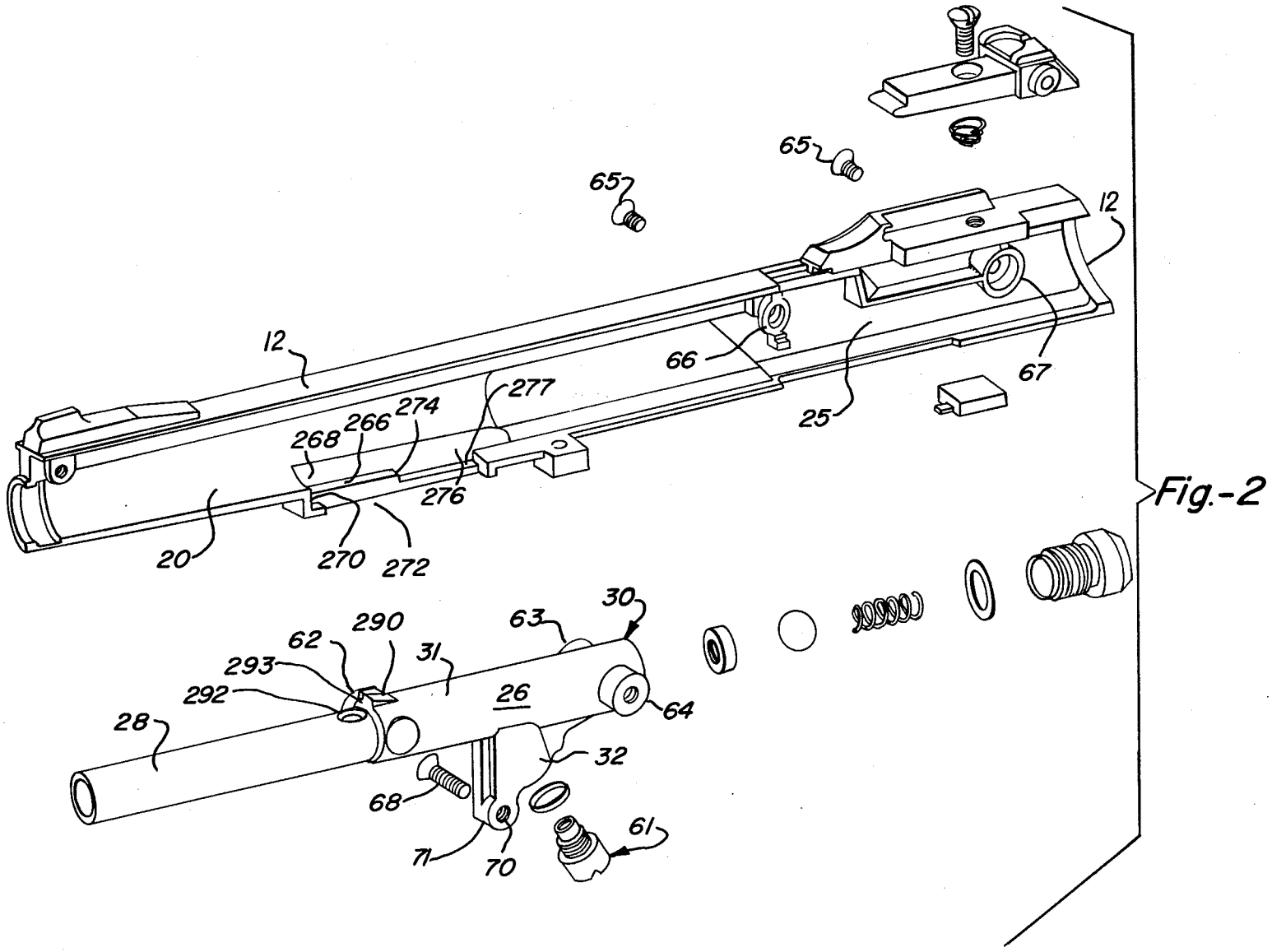
FIG. 2 is an exploded perspective view of the receiver and valve assembly portion of the gun.
Figure 11:
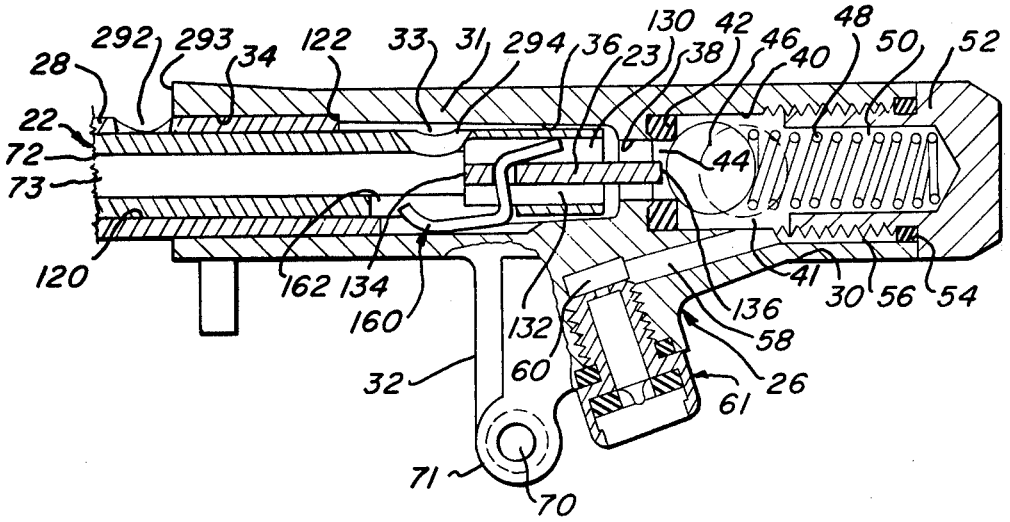
FIG. 11 is an enlarged, fragmentary, detail view of the valve assembly and firing chamber portions of the gun in a second, projectile-releasing stage of the firing cycle subsequent to FIG. 10.

As shown in FIGS. 2 and 11, the valve block assembly 26 comprises an elongated valve block member 30 having an upper portion 31 of generally cylindrical cross section and a lower downwardly extending flange portion 32. An elongated central passage 33, FIG. 11, is formed in upper portion 31 by a series of aligned coaxial counterbore portions 34, 36, 38, 40, providing, respectively, an elongated annular mounting and support chamber for support tube 28, an annular barrel means receiving and guide chamber for barrel means 22, an annular valve stem means receiving and guide chamber for valve-actuating stem means 23, and an annular valve-receiving and pressure-holding chamber 41. A valve seat member 42 of resilient compressible molded plastic material, or the like, having a central circular outlet 44, approximately equal in diameter to bore 38, is fixedly sealably seated at the forward end of bore 40 against the radial shoulder connecting bores 38 and 40. A movable valve means 46, in the form of a ball valve member, is movably mounted in the bore 40 and normally held in sealing engagement with the rear surface of valve seat member 42 by a compression spring member 48 supported in a retaining chamber 50 in an end plug member 52 threadably mounted in the rear end of bore 40 against a sealing ring member 54. An axially extending slot 56 and a forwardly downwardly inclined gas passage 58 connect bore 40 to a gas inlet chamber 60 provided in flange portion 32 of the valve block member 30 in which a conventional container connecting and puncturing assembly 61 is threadably sealably mounted.

Figure 9:
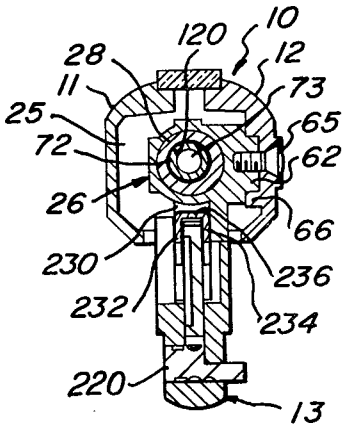
FIG. 9 is a transverse cross-sectional view taken along line 9—9 of FIG. 1.

Referring now to FIGS. 2 and 9, the valve block assembly 26 is mounted between side plate members 11, 12 by a front hub portion 62 and a rear hub portion 63 having threaded bores located therein to receive threaded fasteners 65 extending through corresponding hub portions and bores 66, 67 in the side plate member 12. An internally threaded boss 64 (FIG. 2) on block assembly 26 receives another fastener 65 (FIG. 1) to secure member 11 in place. In addition, the valve block assembly is mounted on the handle member 13 by a threaded fastener 68 extending through a threaded bore in a hub portion 69 on member 13, FIG. 3, and received in a threaded bore 70 in a hub portion 71 on the lower end of flange portion 32, FIG. 2.

Figure 4:
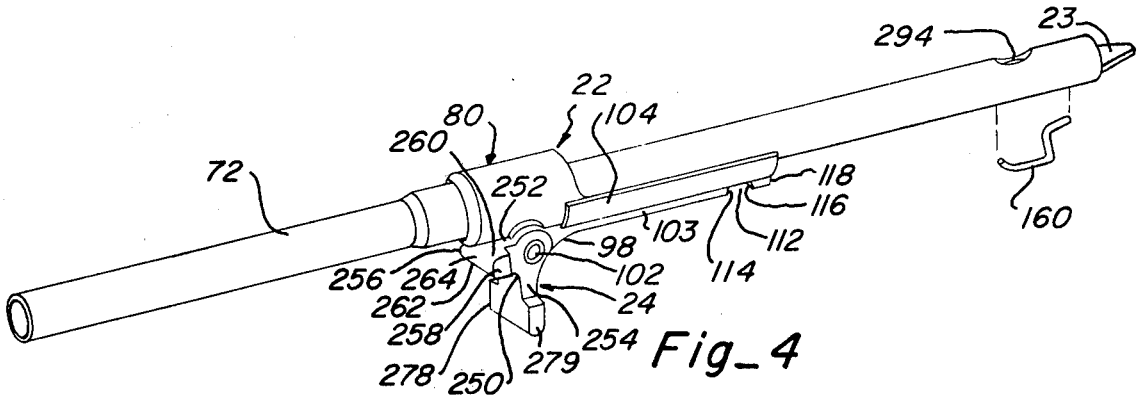
FIG. 4 is a perspective view of the barrel assembly portion of the gun.
Figure 5:
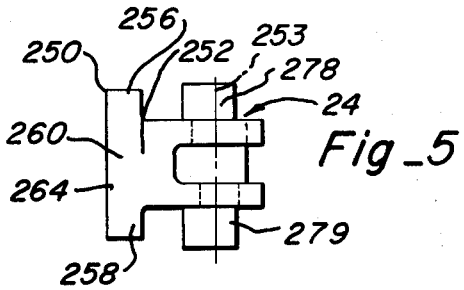
FIG. 5 is an enlarged top plan view of the cocking lever for the gun.
Figure 6:
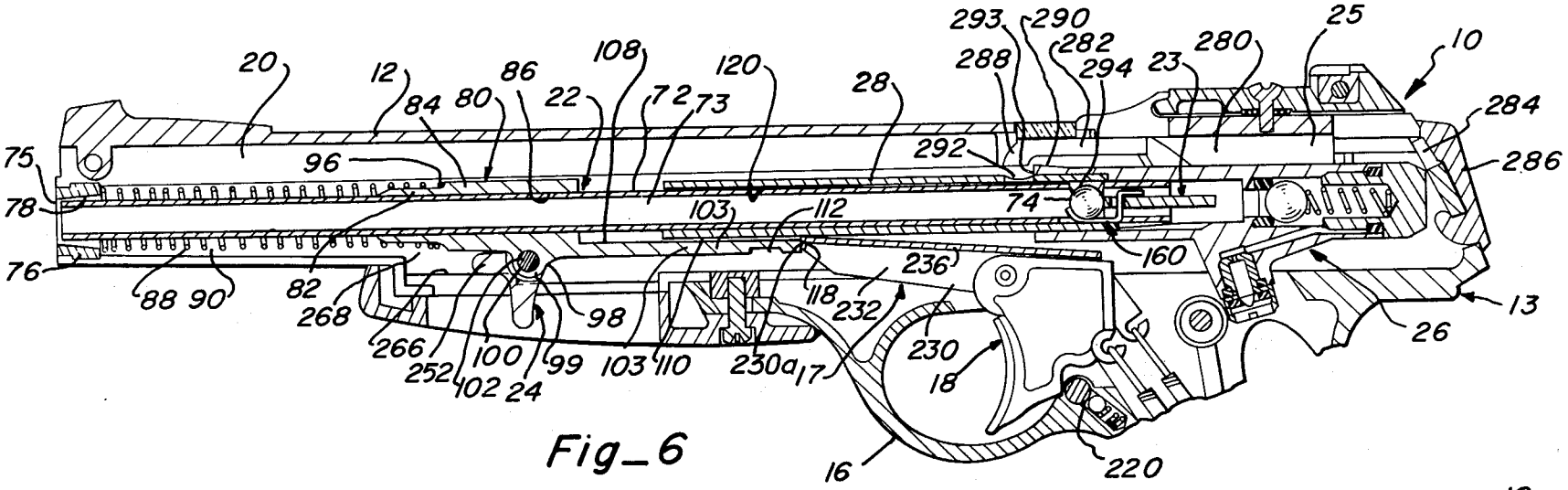
FIG. 6 is a fragmentary, longitudinal cross-sectional view of the gun.
Figure 8:
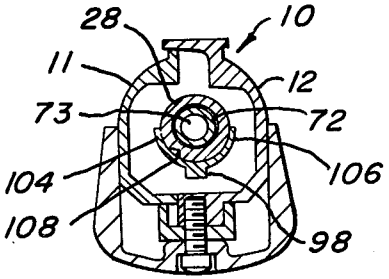
FIG. 8 is a transverse cross-sectional view taken along line 8—8 of FIG. 1.
Figure 7:
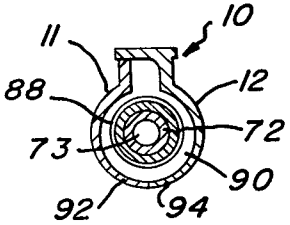
FIG. 7 is a transverse cross-sectional view taken along line 7—7 of FIG. 1.
Figure 14:
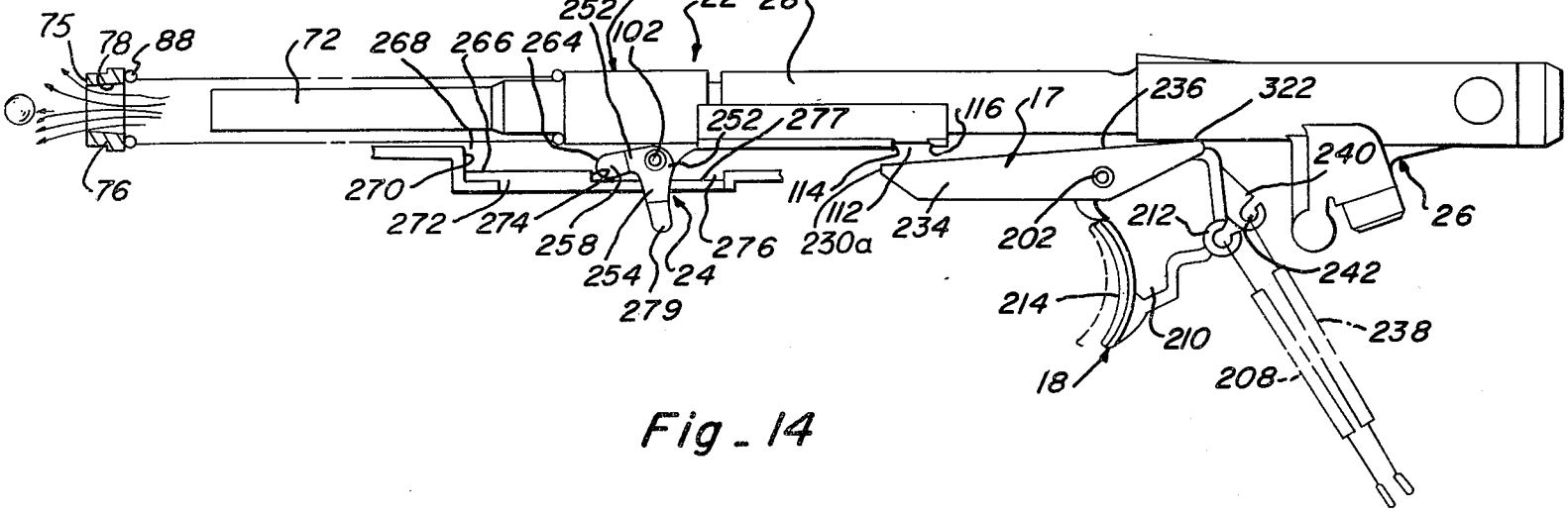
FIG. 14 is a side elevational view of parts of the gun in a fourth stage of the firing cycle subsequent to FIG. 13.
Figure 15:
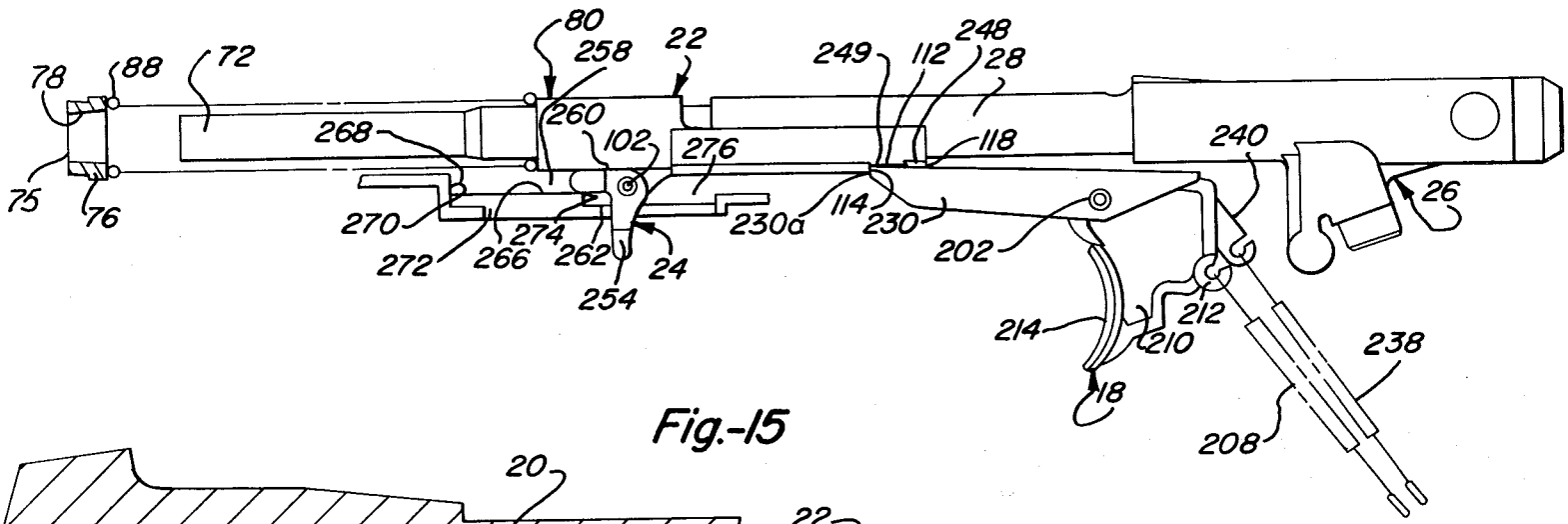
FIG. 15 is a side elevational view similar to FIG. 14 but in an initial position preparatory to loading and cocking.

As shown in FIGS. 6 and 11, barrel means assembly 22 comprises an elongated tubular member 72 having a barrel bore 73 for guiding a projectile 74, such as a BB, from the gun through an opening 75 in an annular end cap member 76 in which the front end portion of the member 72 is located in a forward cocked position shown in FIGS. 1 and 6. The front end of the member 72 may be rounded and the opening 75 formed by a rearwardly outwardly tapered bore 78 facilitating reciprocable movement of the member 72 relative to the member 76 while maintaining clearance therebetween. An operating block member 80 is fixedly mounted on an intermediate portion of member 72 by an elongated forwardly extending cylindrical sleeve portion 82 and a central enlarged cylindrical portion 84 which provide an elongated support bore 86. A compression-operating spring 88 is mounted circumjacent member 72 in a spring chamber 90 formed by receiver wall portions 92, 94, FIG. 7, with the forward end of the spring abutting the rear surface of member 76 and the rear end of the spring abutting a shoulder 96 connecting sleeve portion 82 and enlarged portion 84. As shown in FIGS. 4, 6 and 8, a flange portion 98 extends downwardly and rearwardly from portion 84 with a hub portion 99, FIG. 6, at the forward end having a pivot pin bore 100 extending therethrough to receive a pivot pin 102 pivotally mounting the clocking and latching means member 24. A rearward portion 103 of the flange portion 98 extends beyond the rear end of enlarged portion 84 and has arcuate wing portions 104, 106, FIG. 8, connected thereto to provide an elongated rearwardly extending semi-annular surface 108 radially spaced from the outer surface 110 of tube member 28. As shown in FIGS. 6 and 14-15, a downwardly facing rear slot 112 at the rear end of flange portion 103 provides a rearwardly facing transverse abutment surface 114 and a forwardly facing inclined cam surface 116. The flange portion 103 terminates in a rearwardly facing transverse abutment surface 118.

As shown in FIGS. 6, 9 and 11, the rear end portion of barrel member 72 is closely slidably guidably received in a bore 120 in support tube member 28 which bore generally corresponds in diameter with valve block bore 36. The rear end portion of support tube member 28 is fixedly sealably mounted in valve block bore 34 against abutment surface 122, FIG. 11, and supported therewithin in forwardly extending cantilever fashion. The outside diameter of the rear end portion of barrel member 72 and the inside diameter of bores 36, 120 are substantially equal with the tolerances being such as to enable substantially friction-free relative sliding movement while at the same time effectively sealing the barrel bore 73 relative to the inside surfaces of bores 36, 120 in the firing position of FIG. 11.

Actuating stem means 23, FIGS. 4 and 11, comprises an elongated plate member of rectangular cross section having a width substantially the same as the inside diameter of bore 73 of tube member 72 to enable short side surfaces thereof to be fixedly abuttingly mounted on the inside surface of the tube member by suitable fastening means such as welding. Stem member 23 is mounted coaxially with the central axis of bore 73, and its outer surfaces cooperate with the internal surface of member 72 to define upper and lower semi-annular gas passages 130, 132. The transverse front end surface 134 of member 23 provides a waiting station for a loaded projectile 74, and the transverse rear end surface 136 provides rearwardly facing ball-engaging surface means for centrally impacting the ball 46 and moving the same rearwardly against the bias of spring 48 to enable a gas charge from bore 40 to freely flow through the overall passage defined by bores 38, 44, 36 and passages 130, 132 to the projectile 74. The bore 36 is rearwardly inwardly tapered so that at the rear end thereof the outside diameter of tube member 72 is approximately equal to the diameter of bore 36 to substantially confine gas flow to a direct path between passage 38 and passages 130, 132.

Figure 10:
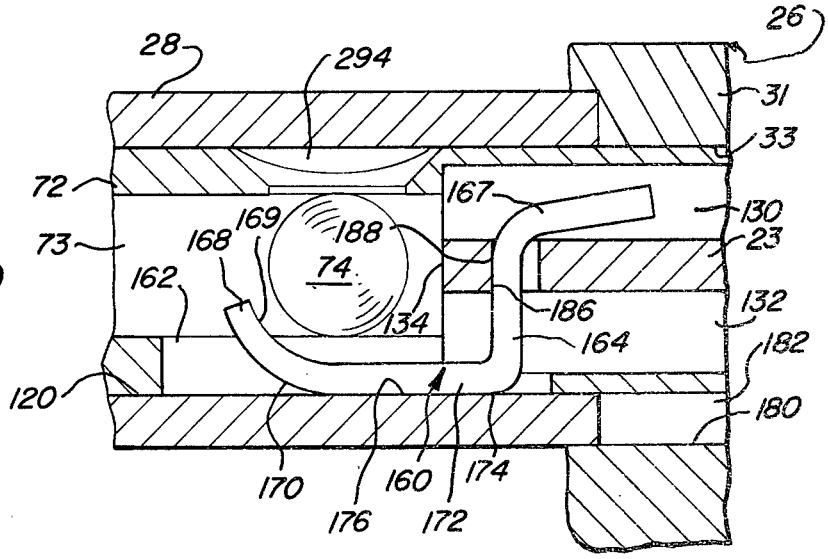
FIG. 10 is an enlarged, fragmentary, detail view of the firing chamber portion of the gun in an initial, projectile-retaining stage of a firing cycle.
Figure 12:
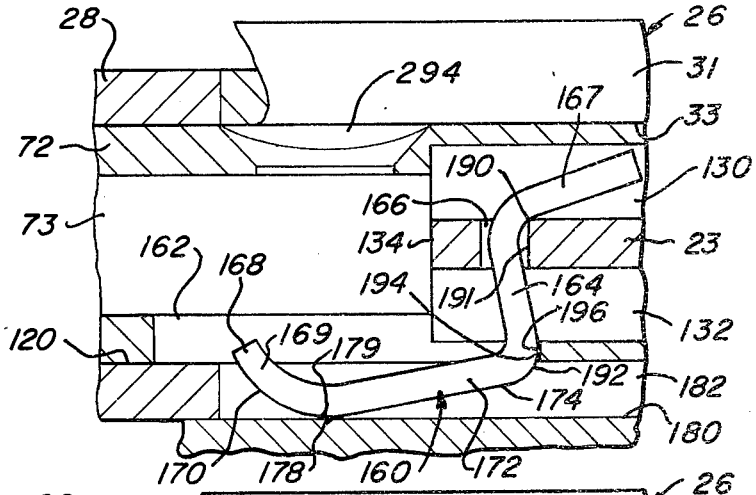
FIG. 12 is an enlarged, fragmentary, detail view of the firing chamber portion of the gun in the releasing position of FIG. 11.

As shown in FIGS. 10–14, a projectile-retaining means, 160, in the form of a formed wire spring member is mounted in an elongated axially extending opening or slot 162 in the bottom rear end wall portion of member 72 for axial movement with member 72 and radial movement relative to member 72 between a projectile-retaining position, FIG. 10, and a projectile-releasing position, FIG. 12. An upwardly radially inwardly extending rear leg portion 164 of member 160 extends through a hole 166 in member 23 with terminal portion 167 rearwardly turned into passage 130 so as to be radially and pivotally displaceably retained in hole 166. An upwardly inwardly forwardly extending curved front tip 168 with a rearwardly facing, curved, projectile-engaging surface 169 has a forwardly and downwardly facing, curved cam follower surface 170. Both the tip 168 and follower 170 comprise parts of a fore-and-aft extending leg portion 172 of retainer 160, such leg portion 172 having a lower elongated support surface 174 slidably engageable with the radially adjacent portion 176 of the surface of bore 120 of member 28 in the retaining position. A rounded connecting surface portion 178 of leg portion 172 is slidably engageable with the radially adjacent portion 179 of a surface 180 in an elongated void 182 in bore 33 of member 31 in the releasing position. In the initial loading and retaining position of FIG. 10, the leg portion 172 extends parallel to surface 176 with surface 174 supported thereby. The curved tip 168 extends into bore 73 to locate curved surface 169 in front of the BB-type projectile 74, thereby confining the projectile in bore 73 between surface 169 and the front side surface 134 of member 23.

Releasing structure for the retainer 160 is defined by the surface 176 and void 182. At the beginning of rearward movement of barrel member 72, the rearwardly facing surface 186 of hole 166 of member 23 fully engages the forwardly facing surface 188 of portion 164 of retainer 160 to transfer rearwardly directed force therebetween. When slot 162 becomes sufficiently aligned with void 182, the retainer 160 pivots downwardly by gravity until surface 178 engages surface portion 179 whereat surface 169 is located completely below bore 73 in slot 162. As may be seen by the position of surface 169 in FIG. 12, the surface 169 clears the bore 73 prior to the time that surface 178 engages surface 179. In the fully released position, retainer 160 is pivotally supported by substantially line contact between the rear surface of terminal portion 167 and the upper rear edge 190 of rear surface 191 of hole 166 and between the rear curved connecting surface 192 and the rear surface 194 of slot 162 at 196.

Figure 13:
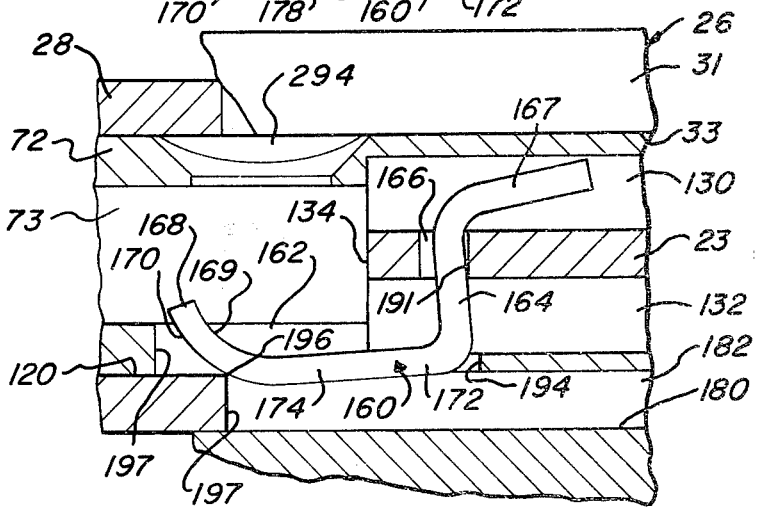
FIG. 13 is an enlarged, fragmentary, detail view of the firing chamber portion of the gun in a third stage of the firing cycle subsequent to FIGS. 11 and 12.

When the barrel member 72 is moved forwardly from the FIG. 12 position, the retainer 160 is moved forwardly by transfer of force through surfaces 191 and 194. As shown in FIG. 13, after forward movement of retainer 160 has begun, curved follower surface 170 engages a cam shoulder in the nature of the front edge 196 of the front surface 197 of void 182 to pivotally upwardly cam the retainer 160 toward the loading and retaining position of FIG. 10 until surface 174 again is aligned with and slidably supported by surface 176 below slot 162.

Figure 3:
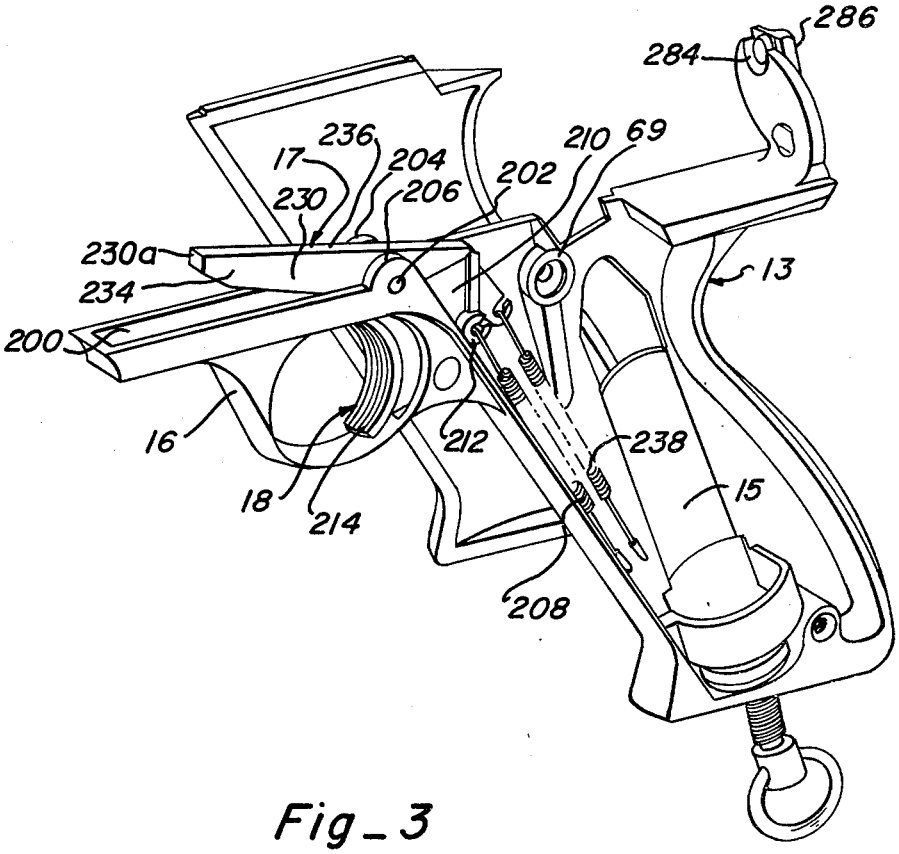
FIG. 3 is an exploded perspective view of the handle-trigger-sear portion of the gun.
Figure 16:
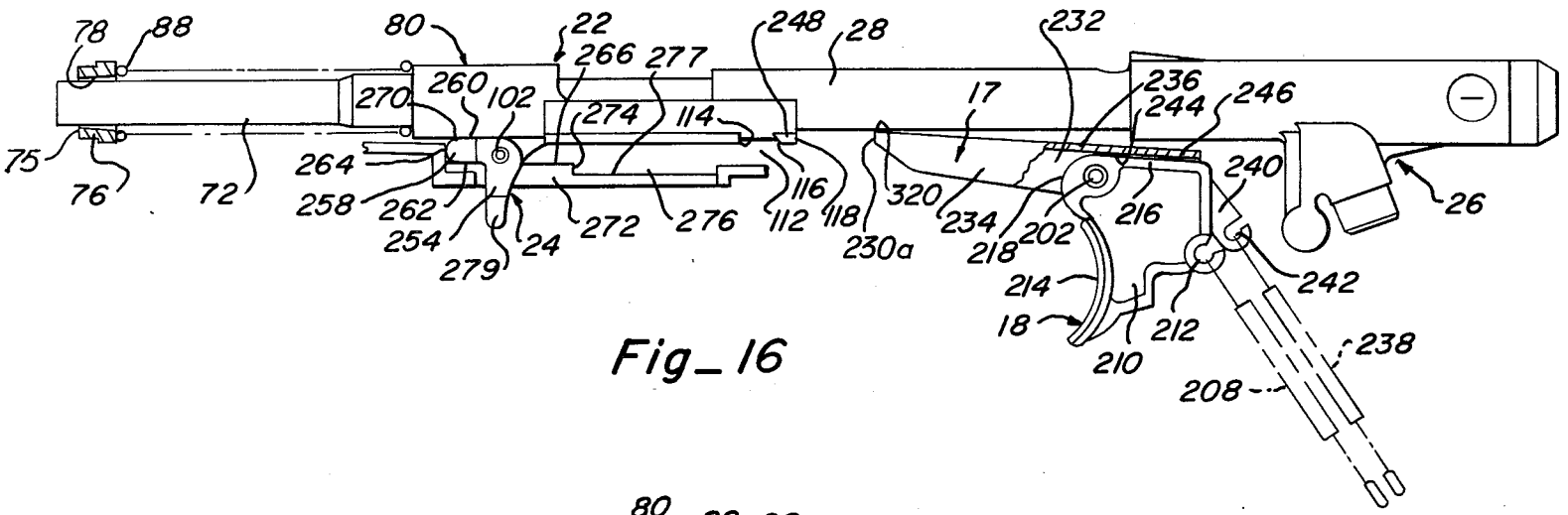
FIG. 16 is a side elevational view similar to FIG. 15 but in a forwardmost loading position.

As shown in FIGS. 3 and 16, the trigger means 18 is pivotally mounted in a slot 200 by a pin 202 extending between lug portions 204, 206 on the handle member 13. A tension spring 208 is connected to a rearwardly extending flange portion 210 of the trigger member at 212 whereby rearward pivotal movement of the trigger member on pin 202, caused by finger applied pressure on trigger surface 214, elongates spring 208 to cause return forward movement of the trigger member when trigger pull force is removed. A flat upwardly facing rib portion 216 extends along the upper part of flange portion 210 and terminates forwardly in a curved cam surface 218. A conventional safety means assembly 220, FIG. 6, is mounted in the handle member 16 and associated with the trigger member.

As shown in FIGS. 3, 6 and 9, the sear means 17 comprises an elongated channel-shaped sear member 230 having side wall portions 232, 234 and a connecting web portion 236 pivotally mounted on pin member 202 independently of the trigger member 18 for movement between a holding position, FIGS. 1 and 2, and a released firing position, FIG. 14. Tension spring means 238 are connected to a rearwardly downwardly extending flange portion 240 of sear member 230 at 242 to bias the sear member toward the holding position. The lower surface 244, FIG. 16, of web portion 236 is supported on the upper surface 246 of flange portion 216 of trigger member 18 rearwardly of pivot 202 and held thereagainst by spring 238. The forward end of sear member 230 has a transverse abutment surface portion 230*a* engageable with the rear surface 118 of rib portion 103 of block member 80.

As shown in FIGS. 4, 5, 15 and 16, the barrel latching and cocking means 24 comprises a member 250 having an elongated generally axially forwardly extending pawl 252, pivotally movable with member 250 about axis 253 of pin 102 between an upwardly displaced released firing and cocking position, FIGS. 1, 2 and 4, and a downwardly displaced barrel latching position, FIG. 14, for terminating forward movement of the barrel means 72. An elongated generally downwardly extending cocking lever arm 254 is pivotally movable with member 250 about pin axis 253. The pawl 252 has laterally outwardly extending lugs 256, 258 at the forward end with flat parallel upper and lower surfaces 260, 262 connected by a curved cam surface 264. As shown in FIG. 16, in the forwardmost loading position, the surface 262 of lugs 256, 258 is disposed above the raised, upwardly facing, spaced surfaces 266 on opposite sides of the slot portions 268, FIG. 2, on receiver members 11, 12 (not shown), and surface 264 abuts a rearwardly facing surface 270 on the receiver members 11, 12 with lever 254 extending downwardly through a slot portion 272. As shown in FIGS. 2, 4 and 6, when the barrel assembly is in the cocked, ready-to-fire position, the surfaces 262 on lugs 256, 258 are still slidably supported on spaced surfaces 266 separated by the slot portion 272. When the sear member 230 is released by pulling trigger 18 to fire the gun, as shown in FIG. 14, the barrel 72 and block member 80 move rearwardly and carry the member 252 rearwardly beyond abutment surface 274 whereupon the lugs 256, 258 of pawl 252 are free to move downwardly by gravity into slot portions 276 onto spaced surfaces 277 by pivotal movement of member 252 about pivot pin 102. Thereafter, forward movement of the barrel member 72 is stopped by engagement of surface 264 with surface 274. In order to thereafter cock and load the gun, lever 254, which has lug portions 278, 279 located downwardly beyond slot 272, is rocked forwardly by hand to disengage surfaces 264, 274 by pivotal upward movement until pawl 252 is realigned above surfaces 266.

It is important to recognize that the center of gravity of the member 252 is located below the axis 103, or, in other words, on the abutment 270 side of an imaginary line drawn parallel to the path of forward travel of axis 103 and intersecting the same. Thus, when the barrel assembly is thrown forwardly during firing, the inertia is such that pawl 252 will be swung counterclockwise into position to strike the abutment 274, notwithstanding the fact that the gun might be on its side and, thus, negate the effects of gravity on pawl 252.

As shown in FIG. 6, projectile storage means 280, in the form of a cavity adapted to hold a relatively large number of projectiles therewithin, is provided above the valve housing assembly 26 and extends axially from a single-file loading passage means 282 to a loading opening 284 covered by a suitable displaceable closure 286. The forward portion 288 of passage 282 is downwardly curved and an upwardly inclined lip 290 on assembly 26 cooperates therewith to facilitate loading and retention of a projectile above a loading port 292 in tube member 28 adjacent a shoulder 293 on the front end of assembly 26. In the loading position of FIG. 16, a loading port 294 in barrel member 72 is aligned with loading port 292 to permit a projectile to be transferred by gravity into the firing chamber in barrel bore 73.

Figure 18:
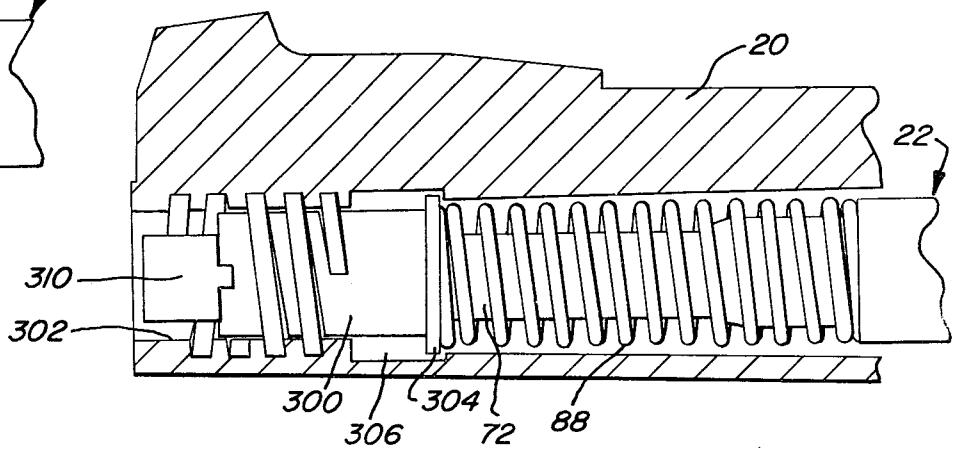
FIG. 18 is another cross-sectional view of the embodiment of FIG. 17 in a maximum velocity position.
Figure 17:
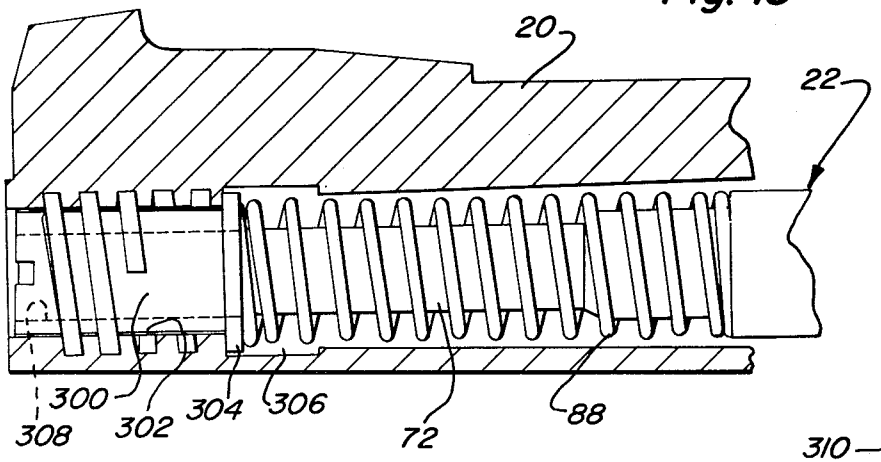
FIG. 17 is an enlarged cross-sectional view of the front end portion of the gun showing an alternative embodiment thereof including velicity adjustment means in a minimum velocity position.

Referring now to FIGS. 17 and 18, an alternative and presently preferred adjustable operating spring means arrangement is shown to comprise an end tube member 300 threadably adjustably mounted in a threaded bore portion 302 with an abutment flange portion 304 engageable with spring 88 and being movable in an annular slot 306 between a forward minimum projectile velocity position, FIG. 17, and a rearward maximum projectile velocity position, FIG. 18. A central bore 308 in member 300 slidably receives the front end 310 of barrel member 72 in all adjusted positions of member 310 which enable selection of varying projectile velocities between the minimum and maximum velocity positions.

OPERATION

In operation of the gun, a compressed gas storage container (not shown) is mounted in the handle portion 13 on seat means 15 (FIG. 1) with a gas outlet passage in sealed communication with inlet chamber 60, passages 56 and 58, and bore 40 which is sealed by ball valve 46 and cap member 52, FIG. 11. The projectile storage slot 280, FIG. 6, is filled with projectiles and a projectile may be partially located in opening 292 against shoulder 293 by slight tilting of the gun.

In order to prepare the gun for firing of a projectile with the gun mechanism in an uncocked position, as shown in FIG. 4, the lever 254 is grasped, rocked upwardly and forwardly to clear pawl 252 from abutment 274, and then pushed forwardly to shift the barrel assembly 22 forwardly against the bias of compression spring 88. If the barrel is shifted fully forward until pawl 252 strikes surface 270, the loading opening 294 in barrel member 72 is brought into alignment with loading opening 292 in support tube member 28, whereupon a single projectile falls into the firing chamber or waiting station and is retained therein by retainer means 160. During the initial portion of the forward movement of the barrel assembly 22, retainer spring member 160 is moved from the release position of FIG. 12 to the retaining position of FIG. 10 by upward camming engagement with cam shoulder 196, FIG. 13. During the forward movement of the barrel assembly, inclined surface 116 enables passage over the sear member 230 by cam action against the bias of spring 238 which thereafter acts to move the sear member upwardly into abutting engagement with the bottom surface of tube 28 at 320, FIG. 16.

When the gun operator releases the lever 254, after a full forward cocking movement of the barrel assembly, spring 88 is effective to move the barrel assembly rearwardly until surface 118 abuts surface 230*a* with loading opening 294 axially rearwardly offset from loading opening 292 to complete the cocking cycle with the gun mechanism in a cocked ready-to-fire position as shown in FIGS. 1 and 6. In the event of accidental or inadvertent release of lever portion 254 prior to completion of a full cocking cycle, the surface 118 will engage surface 230*a* to prevent rearward movement of the barrel assembly to the valve-opening position.

When the safety 220 is manually moved to the firing position, the gun may be fired by rearward pulling force on trigger 18 against the bias of the trigger spring 208. As the trigger flange portion 216 moves upwardly, the front end of sear member 230 is pivoted downwardly against the bias of spring 238 to cause disengagement of abutment surfaces 118, 230*a*, whereupon the compression spring 88 is effective to rapidly drive the barrel assembly 22 rearwardly with spring 238 being effective to hold sear member 230 against the bottom surface of flange portion 103 for relative sliding engagement therebetween. The rearward upward pivotal movement of the trigger and sear is limited by engagement with the bottom surface of the valve housing assembly 26 at 322, FIG. 14. As shown in FIG. 11, as the barrel assembly 22 is rapidly driven rearwardly, the rear end portion of the barrel member 72 enters bore 33 and the rear end portion of stem member 23 enters the bores 38, 44 whereat the rear end surface 136 of member 23 suddenly strikes the central front surface of ball valve 46 to quickly rearwardly displace the ball valve against the bias of the valve spring 48 and the pressure load with the result that a limited relatively small charge of the relatively large quantity of compressed gas stored in the gas storage means provided by bore 40, sufficient to fire the projectile from the gun at a desired velocity, expands into bores 44, 38 into bore 33, which is then effectively sealed by the sealing means provided by the relatively close tolerances maintained between the outside diameter of the barrel member 72 and the diameter of bores 34, 120 with loading openings 292, 294 being similarly sealed. The compressed gas flows into the rear end of barrel bore 73 through passages 130, 132 to drive the projectile from the gun through barrel bore 73, the retainer spring member 160 having dropped into void 182, FIG. 12, just prior to opening of the ball valve.

As soon as the bias of spring 48 and the pressure of the gas in bore 40 acting against the rear surface of the ball valve 46 overcome the rearward inertial forces of the barrel assembly 22, the ball valve is quickly closed to reseal bore 40 with the barrel assembly being quickly moved forwardly a relatively small distance sufficiently to retract the rear end surface 136 of stem member 23 from restraining engagement with the ball valve in bore 44, the bias of the spring 88 in the rearwardly extended position being insufficient to interfere with the required forward movement of the barrel assembly to quickly close the valve. The force available to drive the barrel assembly rearwardly is the primary factor that determines the length of time of opening of passage 44, the amount of compressed gas released and, hence, the velocity of the projectile.

As shown in FIG. 11, as soon as the barrel assembly has moved forwardly a relative short distance to the intermediate propulsion position established by the pawl 252 striking abutment 274, FIG. 14, the front end portion 249 of the sear member 230 enters slot 112 to establish abutting engagement between surfaces 114 and 230*a*.

One advantage of using the ball valve 46 to control the gas outlet 44 in lieu of a flat plate or the like as has heretofore been commonplace, is the highly effective seal that is obtained time after time between the ball 46 and its seat 42. Note that it makes no difference whatsoever that the ball 46 might happen to be rotated or shifted laterally to a slight extent during operation; a new annular contact area will simply be made between the ball 46 and the seat 42 as ball 46 returns into position, and such return will be self-centering in nature. Hence, the quality of seal obtained and the reliability of resealing after operation is quite excellent. It follows, then, that gas wastage and inefficiency as a result thereof is held to a minimum at this critical point in the gun.

Efficiency is further enhanced by the manner in which the ball 46 is unseated, and by the way that the charge is treated upon such unseating of the ball 46. In this regard it is important to note that once the ball 46 is unseated, gas in the chamber 41 has a substantially unrestricted and largely rectilinear line of travel to the back of the projectile 74. The charge issuing from the chamber 41 moves easily around the unseated ball 46 without being forced to turn any right angle corners or to backtrack in order to reach the outlet 44, such lack of tortuous movement being unique to this gun construction as compared to those of the prior art. The relatively large diameter outlet 44 has little, if any, restrictive effect on the gas, and the straight longitudinal surfaces of the stem 23 present no restrictions to the smooth flow of gas to the projectile 74. Although the rearmost end surface 136 of the stem 23 presents a limited amount of surface area against which the gas flow can expend its energy, this is indeed limited and has very little, if any, adverse effect upon the efficiency, particularly when it is considered that such surface is maintained in engagement with the ball 46 throughout much of the time that gas is flowing through the outlet 44.

By combining the attributes of the ball valve 46 with those of "in-line" actuation by the stem 23, the result is a substantial increase in operating efficiency over prior constructions. Instead of the gas flow from the chamber 41 being subjected to numerous restrictions in the form of sharp turns, small orifices and other obstacles in the flow path, the gas charge in the gun of the present invention is allowed to flow in straight line, substantially unencumbered fashion to the projectile 74 so that its available energy is used to propel the latter from the gun instead of to simply reach the projectile.

Improving efficiency in the above manner also has the effect of upgrading performance in that the shooter is assured of essentially constant velocity and trajectory on the projectile each and every time he shoots. Such precision and efficiency are further enhanced by virtue of the fact that the projectile 74 is shifted rearwardly with the stem 23 by the retainer 160 during actuation of the valve ball 46. By thus decreasing the volume of the region behind the projectile 74 and ahead of the outlet 44, and charge issuing from chamber 41 has less opportunity to expand than would be the case if the projectile 74 simply remained stationary relative to the barrel 72 at such time. As a consequence, that energy which the gas would expend in order to expand before reaching the projectile 74 is utilized instead to propel the projectile from the gun.

Moreover, of substantial significance is the fact that the retainer 160 offers no power-robbing resistance that must be overcome by the expanding gas in order to propel the projectile from the gun. Inasmuch as the retainer 160 releases the projectile 74 prior to the gas acting upon the latter, all of the energies of the gas can be devoted to moving the projectile.

The role of the cocking and latching means 24 is also of substantial significance. Note that because the barrel 72 is effectively located between a pair of oppositely acting sources of spring power (spring 88 on the one hand, and valve spring 48 on the other), there would be a tendency for the barrel 72 to simply oscillate in rebounding fashion between such two springs absent some way to dissipate or terminate the oscillations. Consequently, even though the projectile may have long since left the gun, the barrel 72 might still be oscillating and the stem 23 repeatedly unseating the ball 46 to allow the escape of additional gas charges.

Because of the presence of the pawl 252, however, and the fact that it must project downwardly due to inertia load into the line of the abutment 274 during forward movement of the barrel 72, interengagement between these two structures immediately brings the barrel 72 to a halt so that the latter cannot be "reloaded" by the front spring 88 and subjected to additional valve-actuating, rearward movement until the shooter intentionally recocks for the next shot.

Terminating forward movement of the barrel 72 through the use of the pawl 252 in this manner is significant also from the standpoint of decreasing the volume of the gas expansion space behind the projectile 74 during the firing process. Note in this regard that the rear end portion of the barrel 72 does inherently occupy a certain amount of space within the flow path for the gas charge from chamber 41 to the projectile. Consequently, any movement of such structure out of that area only increases the available volume for the gas to expand, thereby reducing the energy that is available to act against the projectile. It follows, then, that by terminating forward movement of the barrel 72 substantially short of its full extent of forward travel the volume of the expansion space behind the projectile is correspondingly held to a minimum. Thus, the efficiency of the gun and its predictability of performance are significantly enhanced.

Having thus described the invention, what is claimd as new and desired to be secured by Letters Patent is:

1. In a gas-powered gun having a gas expansion space defined between a forwardly disposed projectile and a rearwardly disposed control valve with respect to the direction of projectile travel out of the gun, and further having a barrel for the projectile and a rearwardly movable actuator in said space for momentarily unseating said valve to admit a sudden projectile-propelling charge of gas into said space, the improvement comprising:

means other than said barrel for moving the projectile rearwardly with said actuator during said movement of the latter whereby to decrease the dimensions of said space and thereby reduce the amount of energy loss due to wasted volumetric expansion of said charge, said means including a retainer movable with said actuator and structure for releasing said retainer only after a predetermined amount of rearward movement by the projectile.

2. In a gas-powered gun having a gas expansion space defined between a fowardly disposed projectile and a rearwardly disposed control valve with respect to the direction of projectile travel out of the gun, and further having a rearwardly movable actuator in said space for momentarily unseating said valve to admit a sudden projectile-propelling charge of gas into said space, the improvement comprising:

means for moving the projectile rearwardly with said actuator during said movement of the latter whereby to decrease the dimensions of said space and thereby reduce the amount of energy loss due to wasted volumetric expansion of said charge, said means including a retainer movable with said actuator and structure for releasing said retainer only after a predetermined amount of rearward movement by the projectile, said structure including means defining a void alongside the path of travel of said retainer, said retainer being shiftable into said void and out of a retaining position relative to the projectile when the latter has completed said predetermined amount of rearward movement.

3. In a gas-powered gun as claimed in claim 2, wherein said structure further includes a surface extending forwardly from said void in position to engage and maintain said retainer in said projectile-retaining position prior to rearward movement of the projectile said predetermined amount.

4. In a gas-powered gun as claimed in claim 3, wherein said retainer is disposed for shifting by gravity into said void.

5. In a gas-powered gun as claimed in claim 4, wherein said actuator is provided with barrel means for the projectile extending forwardly from the actuator and secured thereto for movement therewith during unseating of said valve, said barrel means having a laterally disposed clearance opening therein that receives said retainer for operation of the latter by said surface and said void.

6. In a gas-powered gun as claimed in claim 3, wherein said retainer has a generally fore-and-aft extending leg portion that is disposed for actuation by said surface and said void, said leg portion being provided with an inturned, forwardmost, projectile-blocking tip that is movable out of the path of travel of the projectile when said leg portion enters said void.

7. In a gas-powered gun as claimed in claim 6, wherein said leg portion is further provided with a cam follower stretch disposed rearwardly of said tip, there being a cam shoulder between said surface and said void in disposition to engage said follower stretch and return the retainer to its projectile-retaining position upon movement of the actuator forwardly after unseating said valve.

8. In a gas-powered gun as claimed in claim 7, wherein said retainer is additionally provided with a second leg portion extending transversely inwardly from the first-mentioned leg portion for connecting the retainer with the actuator.

9. In a gas-powered gun as claimed in claim 8, wherein said actuator is provided with barrel means extending forwardly therefrom and secured thereto for movement with the actuator, said barrel means having a laterally disposed clearance opening therein through which said first-mentioned leg portion of the retainer may project for operation by said surface, said cam shoulder, and said void.

10. In a gas-powered gun as claimed in claim 8, wherein said first-mentioned leg portion is disposed for entering said void by gravity.

11. In a gas-powered gun as claimed in claim 1, wherein said actuator and projectile are movable rearwardly from a cocked position to accomplish and valve unseating and the projectile is thereafter movable forwardly by the forwardly moving actuator during expansion of the charge in said space; and means for terminating said forward movement of the actuator substantially short of said cocked position whereby to correspondingly limit the increase in volume of said chamber caused by said actuator moving the projectile forwardly.

12. In a gas-powered gun having a gas expansion space defined between a forwardly disposed projectile and a rearwardly disposed control valve with respect to the direction of projectile travel out of the gun, and further having a rearwardly movable actuator in said space for momentarily unseating said valve to admit a sudden projectile-propelling charge of gas into said space, the improvement comprising:

means for moving the projectile rearwardly with said actuator during said movement of the latter whereby to decrease the dimensions of said space and thereby reduce the amount of energy loss due to wasted volumetric expansion of said charge, said actuator and projectile being movable rearwardly from a cocked position to accomplish said valve unseating and the projectile being thereafter movable forwardly by the forwardly moving actuator during expansion of the charge in said space; and means for terminating said forward movement of the actuator substantially short of said cocked position whereby to correspondingly limit the increase in volume of said chamber caused by said actuator moving the projectile forwardly, said terminating means including a one-way pawl and cooperating abutment operable to affect only forward movement of said actuator.

13. In a gas-powered gun as claimed in claim 12, wherein said pawl is coupled with the actuator for fore-and-aft movement therewith, said abutment being disposed alongside the path of travel of said pawl.

14. In a gas-powered gun as claimed in claim 13, wherein said pawl is disposed for gravitational movement toward an abutment-engaging position.

15. In a gas-powered gun as claimed in claim 13, wherein said pawl is mounted for swinging movement between abutment-clearing and abutment-engaging positions.

16. In a gas-powered gun as claimed in claim 15, wherein said pawl is disposed for gravitational movement toward said abutment-engaging position.

17. In a gas-powered gun as claimed in claim 16, wherein the center of gravity of the pawl is located for disposition on the abutment side of a line parallel to the path of travel of the swinging axis of the pawl and intersecting said axis when the pawl is in said abutment-clearing position whereby the inertia associated with forward movement of the pawl during said expansion of the charge urges the pawl toward its abutment-engaging position.

18. In a gas-powered gun as claimed in claim 15, wherein said pawl has an operating lever associated therewith for manual swinging of the pawl to its abutment-clearing position and for manual movement of said actuator forwardly to its cocked position.

19. In a gas-powered gun provided with an actuator that is spring-driven by a first compression spring in a rearward direction from a cocked position a valve-opening position for releasing a sudden charge of projectile-propelling gas and is then spring-returned by a second compression spring in the opposite forward direction toward said cocked position, the improvement comprising:

means other than said springs for terminating said return movement of the actuator before the actuator can re-compress said first spring and at an intermediate position substantially free from spring force in either of said directions whereby to avoid additional, unintended valve openings caused by rebounding oscillations of the actuator the forwardmost position of said actuator for said return movement being rearward of said cocked position and being said intermediate position.

20. In a gas-powered gun as claimed in claim 19, wherein said terminating means includes a one-way pawl and cooperating abutment operable to affect only said return movement of said actuator.

21. In a gas-powered gun as claimed in claim 20, wherein said pawl is coupled with the actuator for movement therewith, said abutment being disposed alongside the path of travel of said pawl.

22. In a gas-powered gun as claimed in claim 21, wherein said pawl is disposed for gravitational movement toward an abutment-engaging position.

23. In a gas-powered gun as claimed in claim 21, wherein said pawl is mounted for swinging movement between abutment-clearing and abutment-engaging positions.

24. In a gas-powered gun as claimed in claim 23, wherein said pawl is disposed for gravitational movement toward said abutment-engaging position.

25. In a gas-powered gun as claimed in claim 24, wherein the center of gravity of the pawl is located for disposition on the abutment side of a line parallel to the path of travel of the swinging axis of the pawl and intersecting said axis when the pawl is in said abutment-clearing position whereby the inertia associated with return movement of the pawl urges the same toward its abutment-engaging position.

26. In a gas-powered gun as claimed in claim 23, wherein said pawl has an operating lever associated therewith for manual swinging of the pawl to its abutment-clearing position and for manual movement of the actuator to its cocked position.

* * * * *